US007392916B1

(12) United States Patent
Kuighadush

(10) Patent No.: US 7,392,916 B1
(45) Date of Patent: Jul. 1, 2008

(54) RETRACTABLE STRAW FOR DRINKING CONTAINERS

(76) Inventor: Danny H. Kuighadush, 139-50 Pershing Cresent, Briarwood, NY (US) 11435

( * ) Notice: Subject to any disclaimer, the term of this patent is extended or adjusted under 35 U.S.C. 154(b) by 117 days.

(21) Appl. No.: 09/669,245

(22) Filed: Sep. 25, 2000

(51) Int. Cl.
*A47G 19/22* (2006.01)

(52) U.S. Cl. ..... 220/707

(58) Field of Classification Search ..... 220/707
See application file for complete search history.

(56) References Cited

U.S. PATENT DOCUMENTS

| | | | | |
|---|---|---|---|---|
| 3,071,303 | A * | 1/1963 | Pugh | 200/707 |
| 3,946,895 | A | 3/1976 | Pugh | 220/269 |
| 4,043,478 | A | 8/1977 | Duncan | 220/90.2 |
| 4,078,692 | A | 3/1978 | Stein | 220/90.2 |
| 4,109,817 | A | 8/1978 | Payne et al. | 220/90.2 |
| 4,124,144 | A | 11/1978 | Radek | 221/191 |
| 4,194,674 | A | 3/1980 | Pearson | 229/7 |
| 4,226,356 | A | 10/1980 | Lemelson | 229/7 |
| 4,228,913 | A | 10/1980 | Mack et al. | 220/90.2 |
| 4,305,521 | A | 12/1981 | Komatsuta et al. | 220/90.2 |
| 4,424,913 | A | 1/1984 | Ko | 220/90.2 |
| 4,462,503 | A | 7/1984 | Di Raffaele et al. | 220/90.2 |
| 4,520,930 | A | 6/1985 | Lisiecki | 206/628 |
| 4,624,384 | A | 11/1986 | Ko | 220/212 |
| 4,669,124 | A | 5/1987 | Kimura | 383/80 |
| 4,709,829 | A | 12/1987 | Johnson et al. | 220/90.2 |
| 4,712,702 | A | 12/1987 | Ayabe et al. | 220/90.2 |
| 4,728,001 | A | 3/1988 | Serba | 220/90.2 |
| 4,733,785 | A | 3/1988 | Turner, Jr. et al. | 215/229 |
| 4,788,106 | A | 11/1988 | Short | 428/447 |
| 4,826,034 | A | 5/1989 | Forbes | 220/90.2 |
| 4,852,213 | A | 8/1989 | Shewchuk | 16/266 |
| 4,923,083 | A | 5/1990 | Forbes | 220/90.2 |
| 4,923,084 | A | 5/1990 | Forbes | 220/90.2 |
| 5,005,717 | A | 4/1991 | Oilar | 215/13.1 |
| 5,018,635 | A | 5/1991 | Whittaker | 220/90.2 |
| 5,039,012 | A | 8/1991 | Inaba | 239/33 |
| 5,048,709 | A | 9/1991 | Alverson | 220/90.2 |
| 5,109,995 | A | 5/1992 | Lou | 215/1 |
| 5,127,827 | A | 7/1992 | Hoetzl et al. | 432/72 |
| 5,172,827 | A | 12/1992 | Chang et al. | 220/707 |
| 5,188,283 | A | 2/1993 | Gu | 229/103.1 |
| 5,201,459 | A | 4/1993 | Bettle, Jr. et al. | 229/103.1 |
| 5,253,779 | A | 10/1993 | Lee | 220/705 |
| 5,328,069 | A | 7/1994 | Cohanfard | 224/148 |
| 5,341,217 | A | 8/1994 | Florsek | 345/529 |
| 5,409,124 | A | 4/1995 | Nasrallah et al. | 215/1 |
| 5,415,002 | A | 5/1995 | Koenig | 62/63 |
| 5,415,312 | A | 5/1995 | Mueller | 220/254 |
| 5,431,297 | A | 7/1995 | Rosello | 220/706 |

(Continued)

*Primary Examiner*—Stephen K. Cronin
(74) *Attorney, Agent, or Firm*—Sofer & Haroun, LLP

(57) ABSTRACT

A cap assembly for use in conjunction with a container having a base portion and a top portion. The base portion has a neck and a lip. The neck and lip are dimensioned to be attached to the container. The base portion has a straw hole and an air hole. The top portion is attached to the base portion by a flexible bridge. The top portion has a gripping flange for sealing the straw hole and an air hole stopper for sealing said air hole. Also integral to the top portion is a clip for holding the top portion to said base portion. A straw is adapted to be positioned within the straw hole of the base.

8 Claims, 9 Drawing Sheets

U.S. PATENT DOCUMENTS 5,477,994 A 12/1995 Feer et al. ..... 222/484
5,481,853 A 1/1996 Nasrallah et al. ..... 53/453
5,482,202 A * 1/1996 Wen ..... 200/707
5,518,142 A 5/1996 Lin ..... 220/707
5,520,304 A 5/1996 Lin ..... 220/707
5,547,103 A 8/1996 Murphy et al. ..... 220/709
5,579,948 A 12/1996 Lin ..... 220/707
5,582,320 A 12/1996 Lin ..... 220/708
5,586,681 A 12/1996 Policappelli ..... 220/674
5,597,089 A 1/1997 Smith ..... 220/710
5,819,979 A 10/1998 Murphy et al. ..... 220/706
5,823,422 A 10/1998 Collier et al. ..... 229/103.1
5,873,656 A 2/1999 Arkins et al. ..... 383/202
5,975,340 A 11/1999 Cornell et al. ..... 220/706
5,996,832 A 12/1999 Nieuwoudt ..... 220/257
5,997,177 A 12/1999 Kaufman ..... 383/5
6,000,573 A 12/1999 Murphy et al. ..... 220/710
6,036,048 A 3/2000 Fischman ..... 220/706
6,050,444 A 4/2000 Sugg ..... 220/707
6,056,149 A 5/2000 Murphy et al. ..... 220/705
6,076,729 A * 6/2000 Cornell et al. ..... 200/707
6,090,215 A 7/2000 Cooper ..... 134/6
6,095,368 A 8/2000 Cornell et al. ..... 220/709
6,293,394 B1 * 9/2001 Marbler et al. ..... 200/707

* cited by examiner

RETRACTABLE STRAW FOR DRINKING CONTAINERS

FIELD OF THE INVENTION

This invention is generally related to an improved retractable straw for drinking containers, and more specifically, to a recloseable cap system that allows a user to conveniently drink liquids out of a container.

BACKGROUND OF THE INVENTION

It is well known to straws to drink liquid out of cans, bottles, and wide variety of other containers. A straw allows a user to create a partial vacuum to draw liquid out of a container and into their mouth so that it can be swallowed. There are many reasons why using a straw may be preferable to drinking directly from the container. To begin, it is often unsanitary to drink from the exposed parts of a container. These parts of the container often become dirty when the container is shipped or awaits purchase. By using a straw, a user avoids direct contact with any of the exposed portions of the container. Another reason for using a straw is to avoid contact with sharp—and therefore sometimes dangerous—parts of a container, e.g., the mouth of an aluminum can. Yet another reason for using a straw is the added convenience it brings to drinking from a container. Specifically, when a straw is being used, the container does not need to be tipped in order to drink.

Straws typically must be purchased separately from drinks, or they are provided gratis to a drink buyer at the point of sale. Straws that are separate from containers often become misplaced. Therefore, it has been known to attach straws to some containers, e.g., drink boxes. Even more convenient is providing a drink container which includes a self-contained straw. As evidenced by prior art patents, there have been many attempts to provide such a container.

For instance, U.S. Pat. No. 4,194,674 to Pearson is for a container with a built in straw. The patent discloses a drinking straw that is formed with a flexible corrugated section of material that is fixed to a flexible tab. The tab may be bonded between the sealing flaps of a paper container with the straw held inside the container. Alternatively, the tab can be fixed between the seal disk and cap of a bottle so that the straw may be suspended inside a bottle. This reference provides no teaching of a cap system that is recloseable.

Another example is U.S. Pat. No. 4,109,817 to Payne et al. for a straw assembly for a liquid container. The patent discloses a straw assembly for a liquid container having a pull tab closure over an opening in its top. The straw—which has a float mounted thereon—is free to extend to its full length when the container is opened. The device disclosed in this reference is not recloseable. Moreover, this is a relatively complicated design.

Thus there is a need for a recloseable cap system for a beverage container that integrates a straw for convenient user access.

OBJECTS AND SUMMARY OF THE INVENTION

It is a primary object of the present invention to provide an improved retractable straw for use with a beverage container, that overcomes the shortcomings of prior art devices.

It is another object of the present invention to provide a retractable straw that is integrated into a cap that is recloseable.

A more specific object of the present invention is to provide a retractable straw cap system that has multiple sealing points for its recloseable cap.

A further object is to provide a cap system that is simple and easy to use.

A still further object is to provide an improved cap system that is economical in cost to manufacture.

Thus, according to one embodiment of the invention, a cap assembly is provided for use in conjunction with a container having a base portion and a top portion. The base portion has a neck and a lip. The neck and lip are dimensioned to be attached to the container. The base portion has a straw hole and preferably an air hole. In one embodiment, the top portion is attached to the base portion by a flexible bridge. The top portion has a gripping flange for sealing the straw hole and an air hole stopper for sealing said air hole. Also integral to the top portion is a clip for holding the top portion to said base portion. A straw is adapted to be positioned within the straw hole of the base.

The above description sets forth rather broadly the more important features of the present invention in order that the detailed description thereof that follows may be understood, and in order that the present contributions to the art may be better appreciated. Further objects and advantages of this invention will be apparent from the following description and appended claims, reference being had to the accompanying drawings forming a part of this specification, wherein like reference characteristics designate corresponding parts in the several views. It is to be understood, however, that the drawings are designed solely for the purposes of illustration and not as a definition of the limits of the invention, for which reference should be made to the appended claims.

BRIEF DESCRIPTION OF THE DRAWINGS

With the above and additional objects and advantages in view, as will hereinafter appear, this invention comprises the devices, combinations and arrangement of parts hereinafter described by way of example and illustrated in the accompanying drawings of preferred embodiments in which like reference characters denote similar elements throughout the several views. The figures are not drawn to scale.

FIG. 8*a* is a perspective view of the cardboard beverage container shown in FIG. 1*a* with an alternative embodiment of an integrated cap system in an open position;

DETAILED DESCRIPTION OF THE INVENTION

Figure 1C:
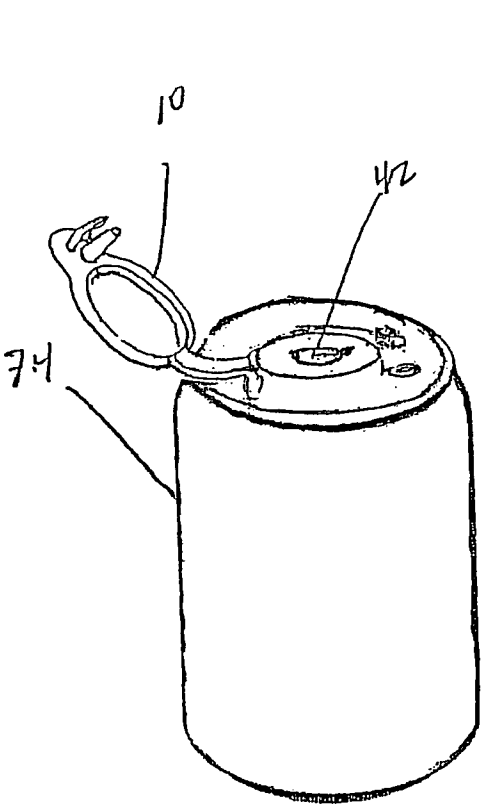
FIG. 1*c* is a perspective view of a can with an integrated recloseable cap system, according to one embodiment of the invention.
Figure 1B:
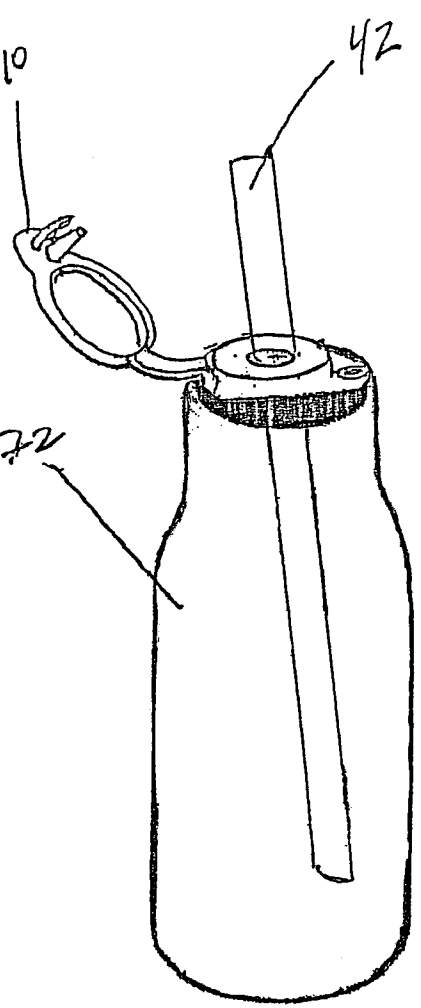
FIG. 1*b* is a perspective view of a bottle with an integrated recloseable cap system, according to one embodiment of the invention.
Figure 1A:
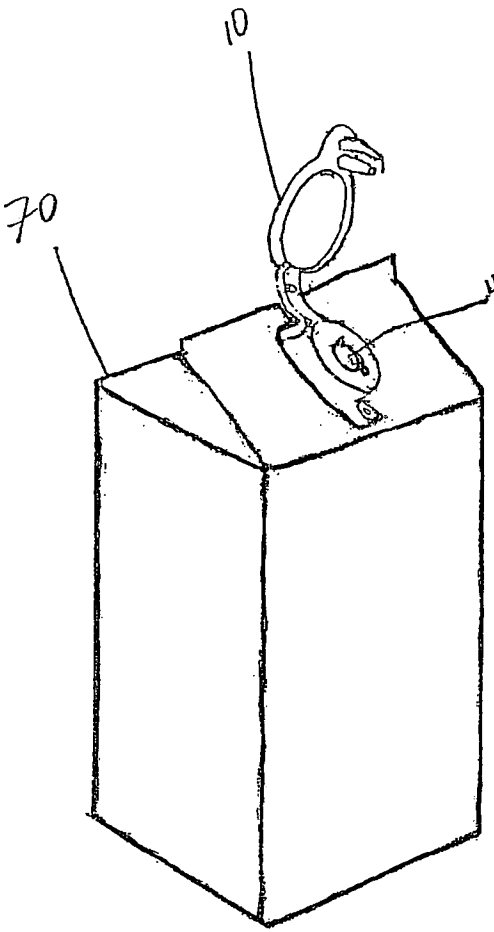
FIG. 1*a* is a perspective view of a cardboard beverage container with an integrated recloseable cap system, according to one embodiment of the invention.

With initial reference to FIGS. 1*a*, 1*b*, and 1*c*, a variety of drinking containers are shown that incorporate a cap system 10. Specifically, FIG. 1*a* shows cap system 10 used with a cardboard carton 70 which typically holds unpressurized beverages such as milk and juice. In FIG. 1*b*, cap system 10 is shown to be integrated into the top of a bottle 72. And, in FIG. 1*c*, cap system 10 is shown to be integrated into the top of a can 74. Cap system 10 includes a straw 42 which is shown in its retracted position in FIGS. 1*a* and 1*c* and in its extended position in FIG. 1*b*. Cap system 10 is designed to serve the dual purpose of sealing a container and providing the user with a conveniently included straw.

Figure 2A:
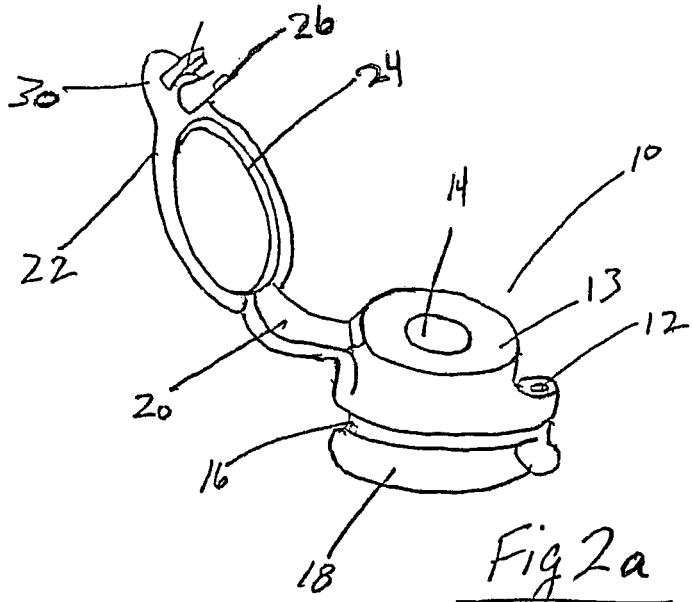
FIG. 2*a* is a perspective view of a recloseable cap system detached from a beverage container, according to one embodiment of the invention.
Figure 2B:
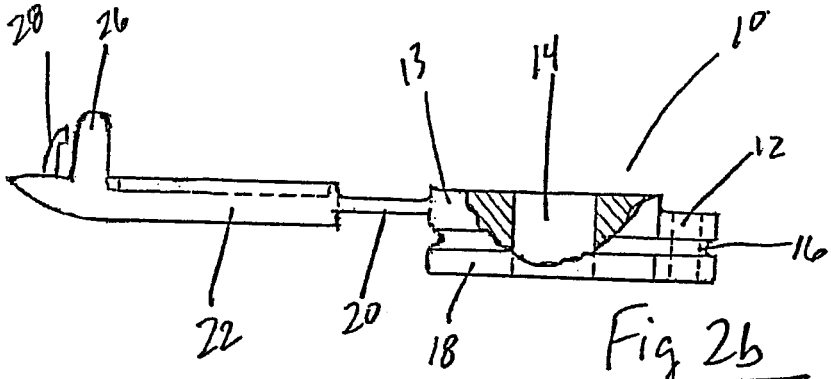
FIG. 2*b* is partial sectional side view of a recloseable cap system detached from a beverage container, according to one embodiment of the invention.
Figure 2C:
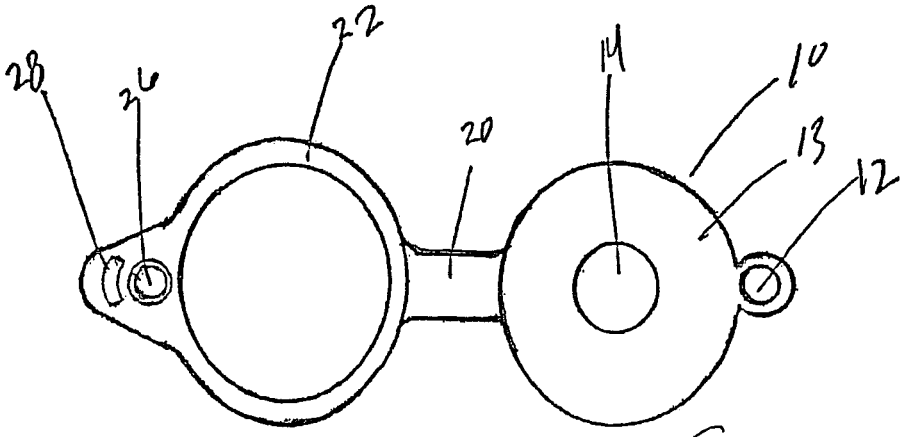
FIG. 2*c* is a top view of a recloseable cap system detached from a beverage container, according to one embodiment of the invention.

With reference to FIGS. 2*a*, 2*b*, and 2*c*, more detailed views of cap 10 are shown. Cap 10 includes a closeable top portion 22 that is connected to a base 13 by a bendable bridge 20. Base 13 has a neck 16 which causes there to be a lip portion 18 at the bottom of base 13. As described in more detail below, neck 16 is used to attach assembly 10 to a container. A straw hole 14, along with an air hole 12, is formed through base 13. As for top portion 22, a gripping flange 24 is formed thereon and corresponds to base 13. Extending from top portion 22 is tab 30 which further includes an air hole stopper 26 and a clip 28. Preferably, assembly 10 is molded from plastic. However, any other suitable material may be used for this purpose.

Figure 3:
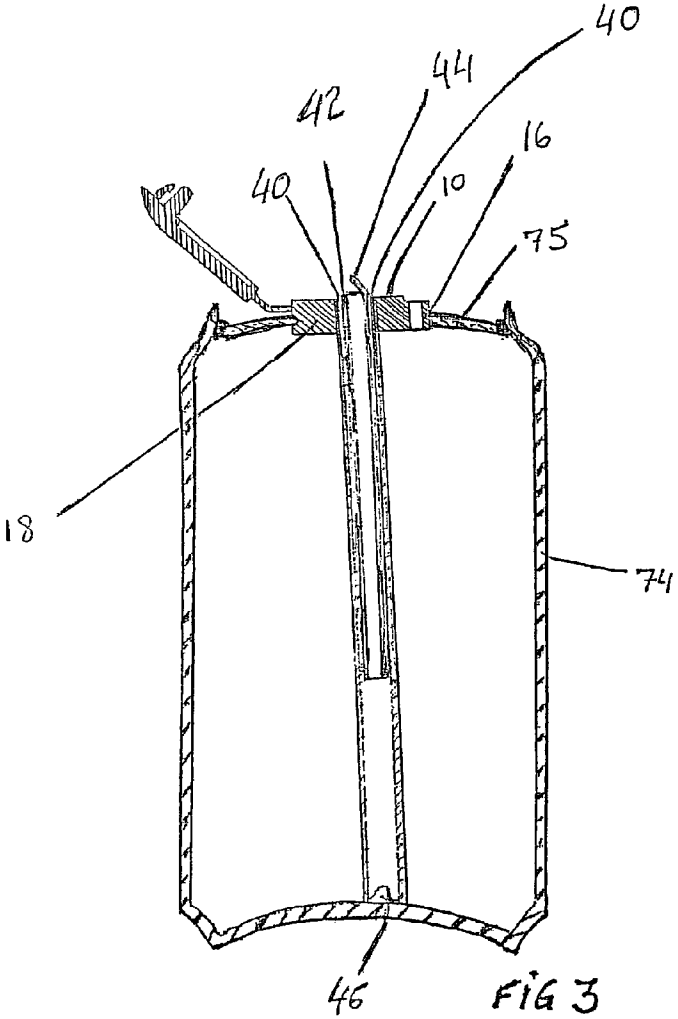
FIG. 3 is a sectional view of the can shown in FIG. 1*c* showing a telescoping straw in a closed position, according to one embodiment of the invention.

Now turning to FIG. 3, top portion 22 is shown attached to can 74 as illustrated in FIG. 1*c*. Neck 16 of base 13 retains the edge of an opening in top portion 75 of can 74 so that lip portion 18 is held on the inside of can 74. Straw 42 in FIG. 1*c* represents an inner straw 42 which telescopes out of an outer straw 40. Inner straw 42 can be friction fit in straw 40. In one embodiment, straw 40 is held in opening 14 of base 18 by friction fit. In another embodiment an adhesive holds straw 40 in place. Instead of attaching straw 40 to cap 10, straw 40 may alternatively be an integral portion of cap 10. It is preferred that the bottom portion of straw 40 has scallops 46 to allow liquid to freely flow into straw 40. Alternatively, a hole (not shown) may be disposed in the bottom portion of straw 40 for the same purpose. For the same effect, straw 40 may be formed shorter than the height of can 74 so that straw does not reach to the bottom where it can be blocked. Inner straw 42 may also include a tab 44, that, as described in more detail below, aids the user in bringing straw 42 into a drinking position.

Figure 5:
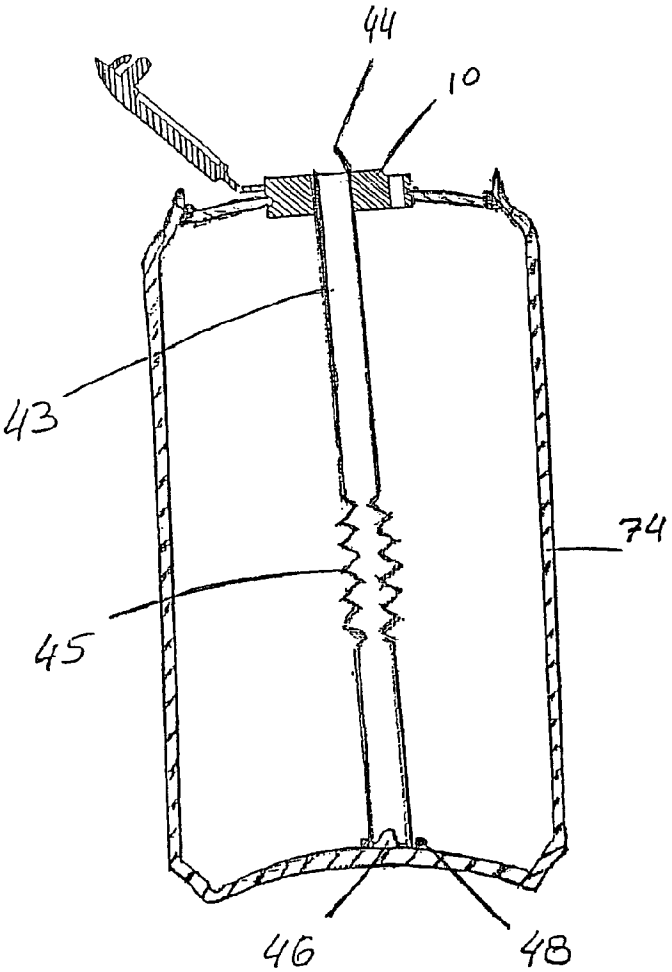
FIG. 5 is a sectional view of the can shown in FIG. 1*c* showing a pleated straw in a closed position, according to one embodiment of the invention.

Now turning to FIG. 5, another embodiment of the invention is shown wherein a single straw 43 is used in conjunction with system 10 as opposed to the telescoping system previously described. Straw 43 has a pleated section 45 that can expand vertically as shown in FIG. 7. In the preferred embodiment, straw 43 also includes a tab 44 for bringing straw 43 into a drinking position. So that scallops 46 remain at the bottom of can 74 when a user pulls straw 43 into a drinking position, food-grade, water-resistant adhesive 48 may be used to hold straw 43 to the bottom of can 74. Scallops 46 may also be biased to the open position shown in FIG. 7 so that when the top is opened, the straw automatically moved into drinking position.

Figure 6:
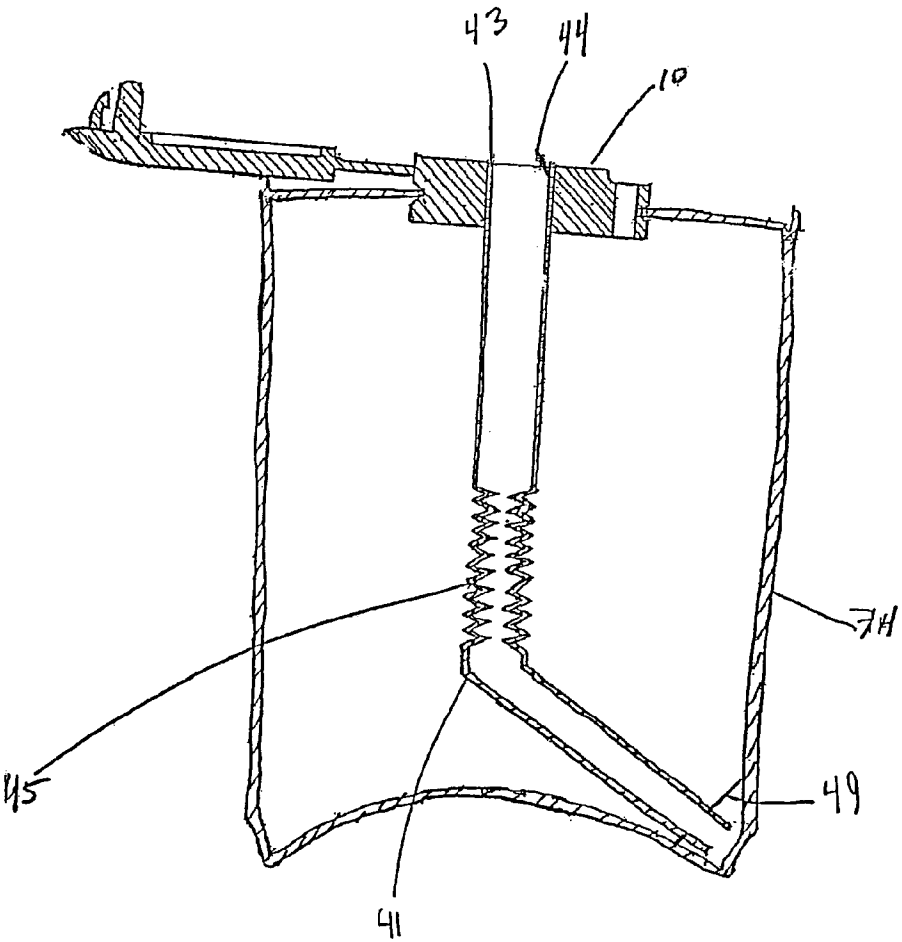
FIG. 6 is a sectional view of the can shown in FIG. 1*c* showing a pleated straw with an elbow in a closed position, according to one embodiment of the invention.

As shown in FIG. 6, straw 43 may have an elbow portion 41 so that the end of the straw can reach the lowest point of can 74. It should be noted that this configuration can be used on any of the previously described embodiments. This has the advantage of allowing the user to reach liquid that may be otherwise unreachable using straw 43 shown in FIG. 5. Also, as shown in FIG. 6, straw 43 is held to the bottom of the can by prongs 49. Prongs 49 can also be used in any of the previously described embodiments and have the advantage of being a relatively inexpensive and dependable way to hold straw 43 in can 74.

Figure 4:
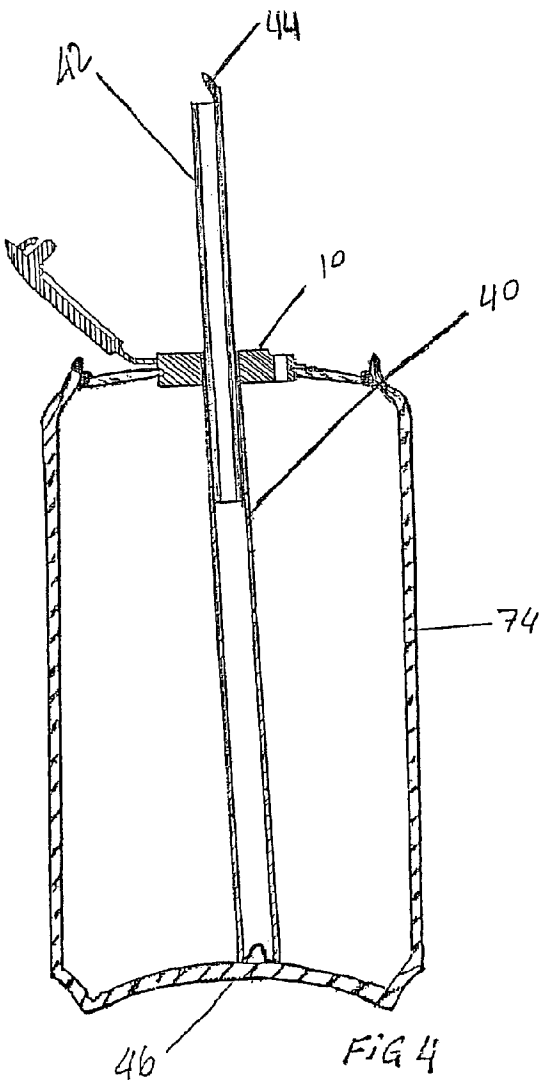
FIG. 4 is a sectional view of the can shown in FIG. 1*c* showing a telescoping straw in an open position, according to one embodiment of the invention.

In order to use assembly 10 shown in FIGS. 3 and 4, a user first opens top portion 22 by grasping tab 30 and lifting it to break the seal formed by gripping flange 24 and base 13. Lifting tab 30 also unlocks clip 28 from base 13 which is a second sealing point for top portion 22. At this time, the seal formed by stopper 26 and air hole 12 is also broken. Now top portion 22 can be rotated to a fully open position by unfolding bridge 20. The user grasps tab 44 with mouth or fingers and pulls inner straw 42 to its extended position as is shown in FIG. 4. Similarly, with regard to the embodiment shown in FIGS. 5, 6, and 7, straw 43 is pulled upward, expanding pleats 45, so that it is in its extended position. Now the user can sip the liquid contents of container 74 which enter straw 40 through scallops 46. As liquid leaves container 74, air enters container 74 through air hole 12 to prevent a partial vacuum from developing. Such a vacuum makes it difficult for the user to continue drinking from container 74. When the user is finished drinking but liquid remains in container 74 that user wishes to save straw 42 may be put into its original closed position and top portion 22 may be folded over base 13 to seal assembly 10.

Figure 7A:
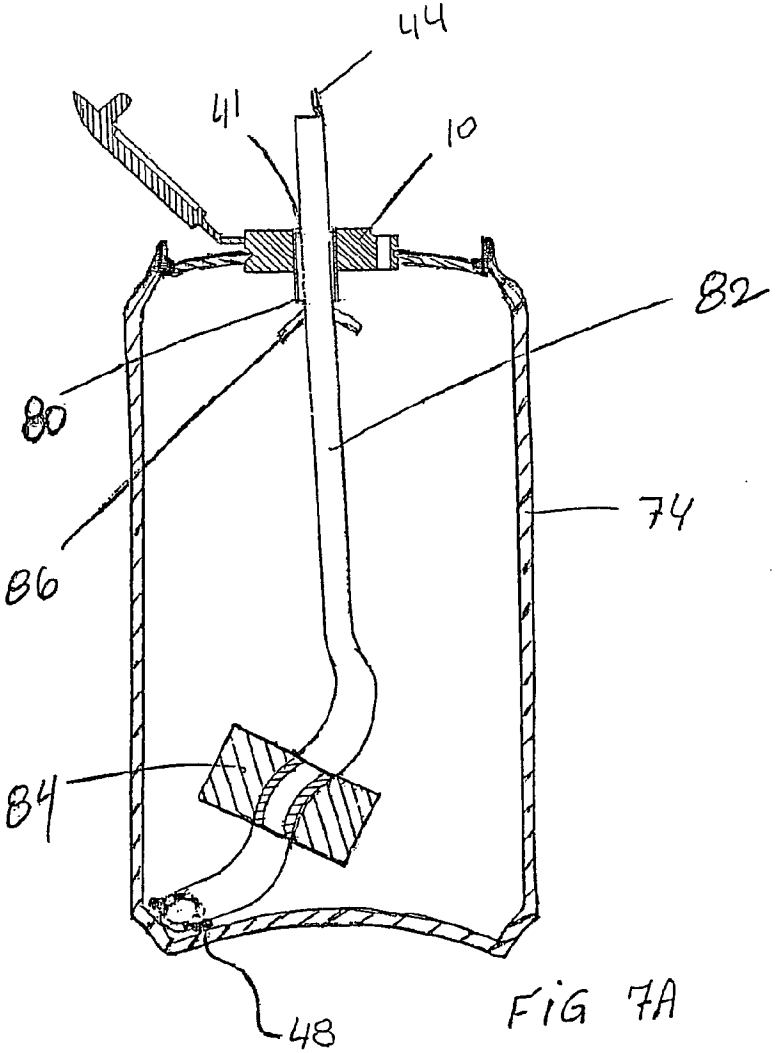
FIG. 7A is a sectional view of the can shown in FIG. 1*c* showing a flexible straw with flotation device, according to one embodiment of the invention.
Figure 7:
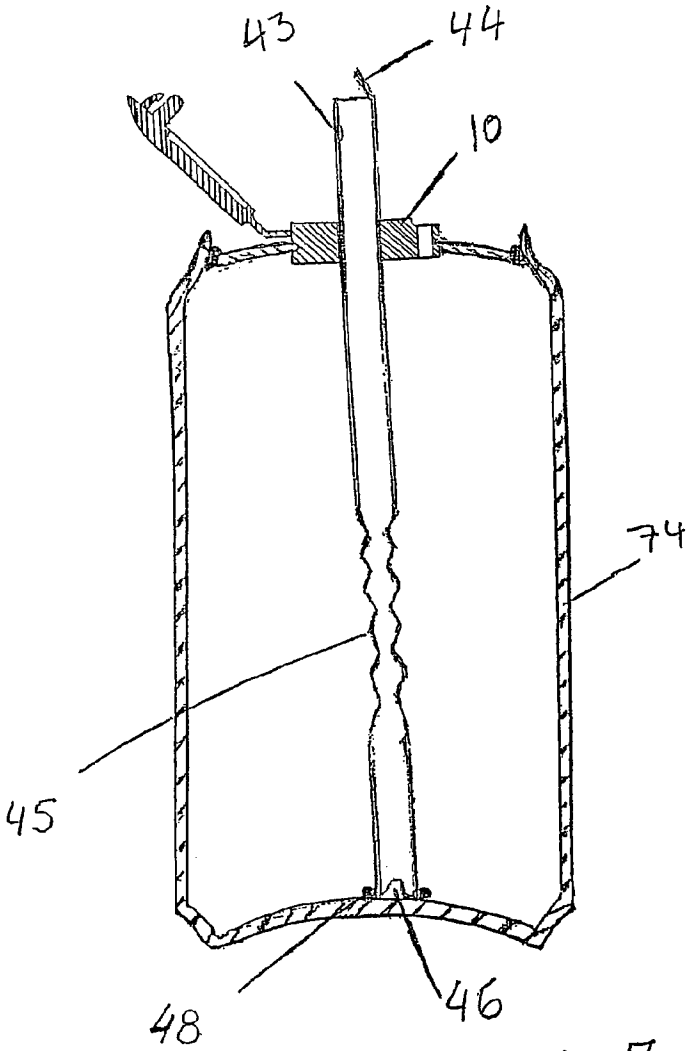
FIG. 7 is a sectional view of the can shown in FIG. 1*c* showing a pleated straw in an open position, according to one embodiment of the invention.

Now turning to FIG. 7A, a flexible straw 82 may also be used in place of straw 43 shown in previous embodiments. Straw 82 may include a float 84 and a stopper 86. Preferably float 84 is a foam material that is relatively lightweight. In one embodiment, float 84 and stopper 86 are attached to straw 82 by friction fit. Straw 82 freely slides in tube 41 which can be integral to cap 10. Straw 48 is held to the bottom of can 74 by adhesive 48 or other appropriate means so that straw 48 is always in contact with liquid that is held in container 74. Float

84 causes straw 82 to be biased against cap 10 when cap 10 is closed. This is a result of the relative buoyancy of straw 82 which includes float 84. Thus, when cap 10 is opened, straw 82 rises out of can 74 until stopper 86 impedes the movement of straw 82.

Figure 8B:
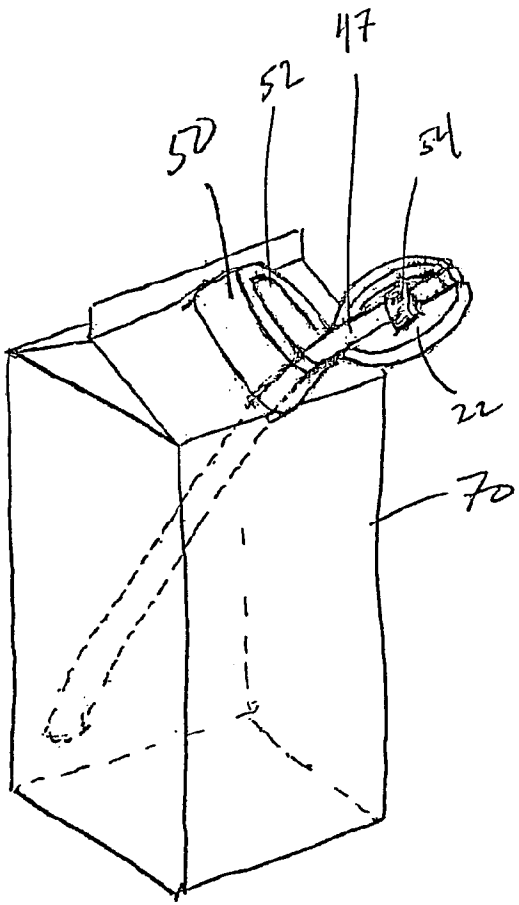
FIG. 8*a* is a perspective view of the cardboard beverage container shown in FIG. 1*a* with an alternative embodiment of an integrated cap system in a closed position.
Figure 8A:
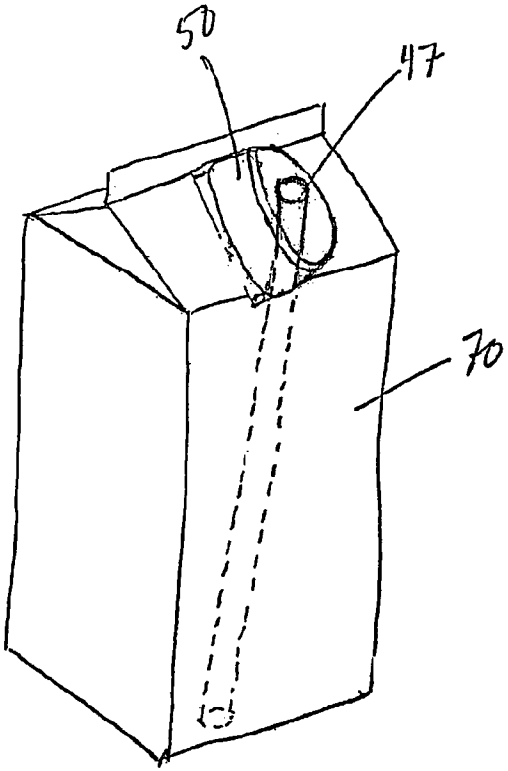

FIGS. 8*a* and 8*b* shows an alternate embodiment of the system where cap 10 as shown in FIG. 2*a* is modified as cap 50 having a relatively larger and rectangular shaped opening 52 for accommodating a straw 47. Cap 50 is configured to be attached to cardboard carton 70 in the inverted position shown, and cap 50 does not have an air hole of cap 10. An air hole is not required because straw 47 does not completely cover opening 52. Cap 50 also has a band 54 (FIG. 8*b*) that is designed to retain the top portion of straw 47.

In order drink from container 70, a user opens top portion 22 of assembly 50 and rotates it open to expose straw 47. Straw 47 may now be pulled completely from band 54 and used as a conventional straw. Alternatively, straw 47 may be pulled out slightly from band 54 to allow the user to drink more easily. Instead, a user may choose to drink from straw as it is shown in FIG. 8*b*.

Figure 9B:
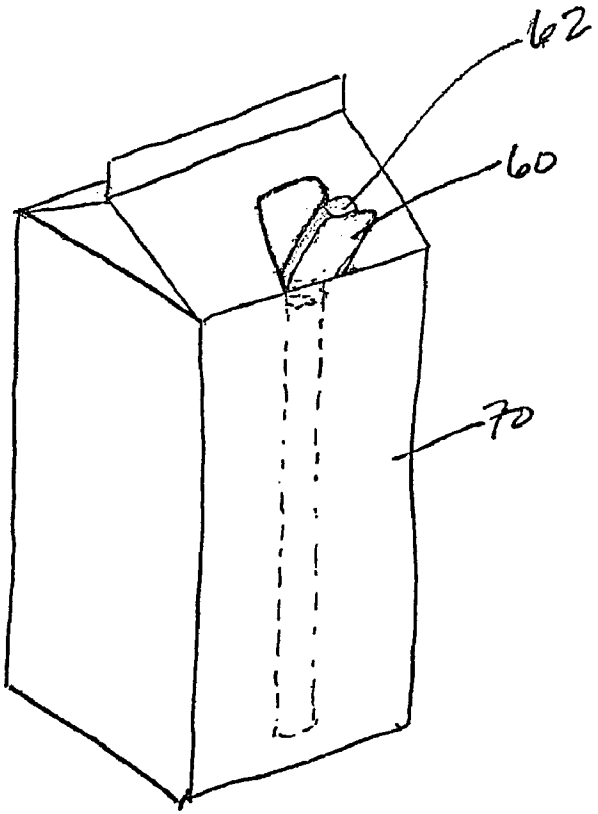
FIG. 9*b* is a perspective view of a cardboard beverage container with an integrated straw in a open position, according to one embodiment of this invention.
Figure 9A:
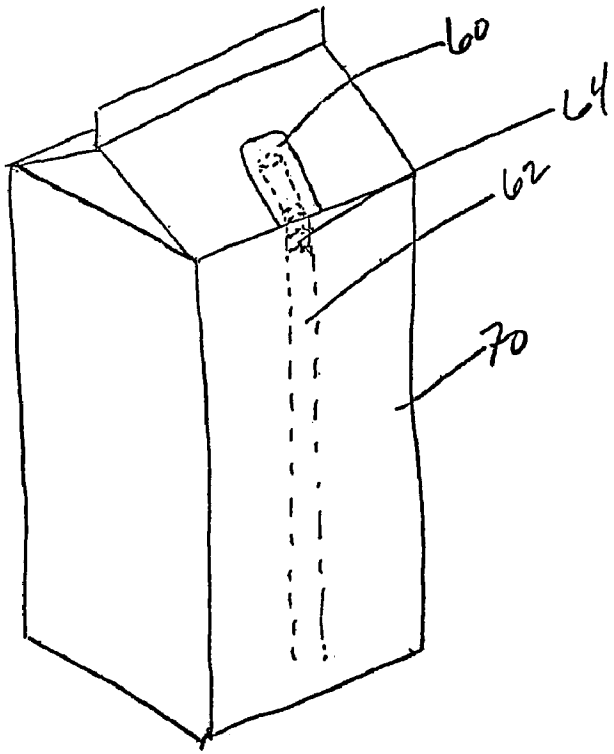
FIG. 9*a* is a perspective view of a cardboard beverage container with an integrated straw in a closed position, according to one embodiment of this invention.

The embodiment of the invention shown FIGS. 9*a* and 9*b* provides access to a drinking straw in a way that is similar to the embodiment in FIGS. 8*a* and 8*b*. However, in this instance, cap assembly 50 is no longer required. Instead, carton 70 has a scored finger 60 that can be pulled open to expose straw 62 that is attached to the underside of finger 60. Straw 62 has pleats 64 that allow it to bend without impeding the flow of liquid.

Figure 10B:
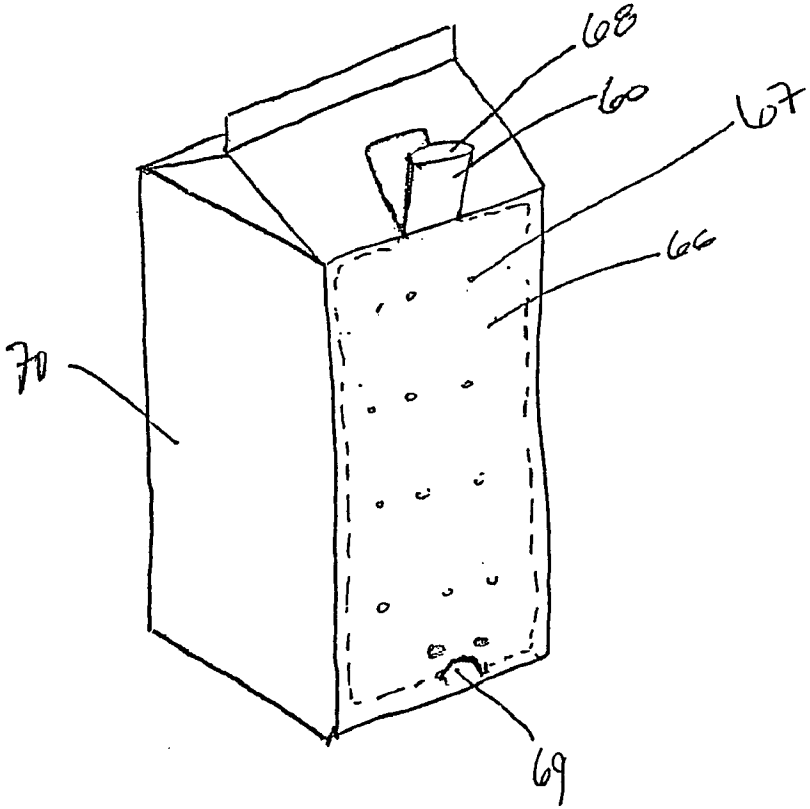
FIG. 10*b* is a perspective view of a cardboard beverage container with an integrated pouch-straw system in a open position.
Figure 10A:
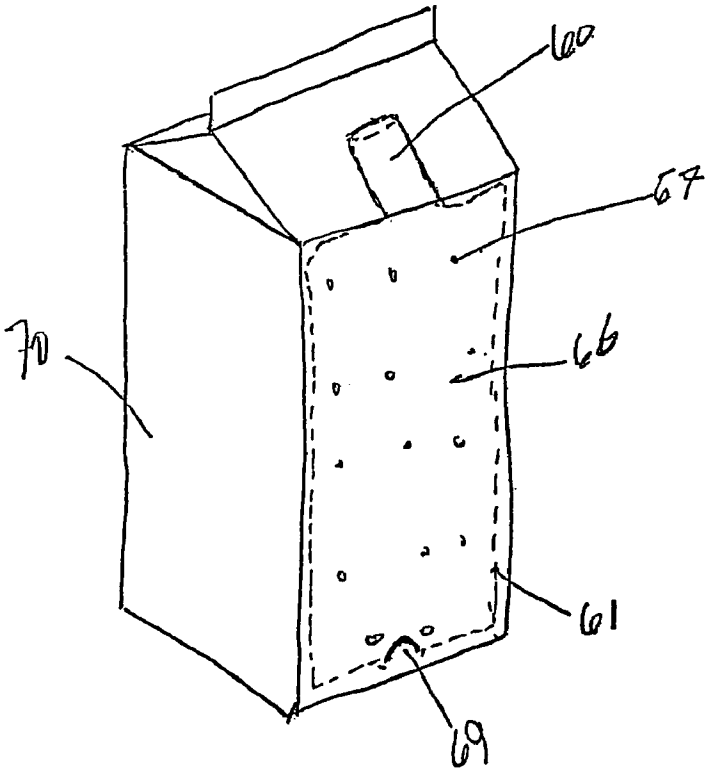
FIG. 10*a* is a perspective view of a cardboard beverage container with an integrated pouch-straw system in a closed position.
Figure 10C:
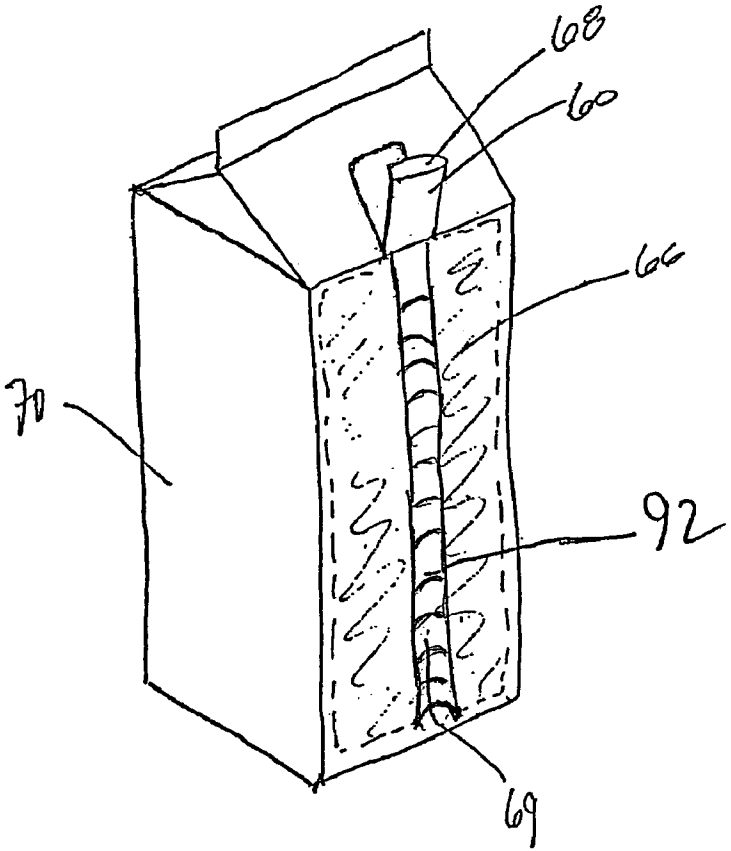
FIG. 10*c* is a perspective view of a cardboard beverage container with an integrated pouch-straw system in a open position, according to another embodiment of the invention.

Another embodiment of the invention is shown in FIGS. 10*a* and 10*b*. In this instance, a pouch 66 is sealed to the inside of container 70 along edge 61. Pouch 66 is opened at either end with holes 68 and 69. In this embodiment, scored finger 60 forms a straw-like neck that communicates between hole 68 and pouch 66. Thus, liquid is drawn through pouch 66 as it would be drawn through a conventional straw. In one embodiment, protuberances 67 extend from the inside of pouch 66 to help prevent pouch 66 from collapsing when a user creates suction while bringing liquid through hole 68. Preferably, pouch 66 is simply a liner that is attached to the inside of container 70 with the container itself serving as part of the pouch. In FIG. 10*c*, pouch 66 is sealed to the inner surface of container 70. A ripple 92 in pouch 66 forms a straw that can be accessed through scored finger 60.

While there has been shown and described particular embodiments of the invention, it will be obvious to those skilled in the art that changes and modifications can be made therein without departing from the invention, and therefore, the appended claims shall be understood to cover all such changes and modifications as fall within the true spirit and scope of the invention. Also it is to be understood that the phraseology and terminology employed herein is for the purpose of description and not of limitation.

What is claimed is:

1. A cap assembly, comprising:

a container having a plurality of sides and an opening disposed on a top portion of said container, said opening disposed at the top of a first one of said plurality of side walls, said opening covered by a cap positionable in an opened and closed position; and an extendable straw, said straw having upper and lower portions, where said lower portion extends downwardly against said first side wall, and wherein said upper portion is coupled with an inner side of said cap so that when said cap is in an opened position, said straw is available at said opening for use.

2. A cap assembly as set forth in claim 1, wherein said cap is a scored finger portion.

3. A cap assembly as set forth in claim 2, said straw further comprising pleats disposed between said upper portion of said straw located on said cap and said second lower portion disposed along said first side wall so that said straw can bend over a base of said scored finger portion.

4. A cap assembly as set forth in claim 2 wherein a top opening of said straw is disposed co-planar with a top side of said scored finger portion.

5. A cap assembly, comprising:

a container having a plurality of sides and an opening disposed on a top portion of said container, said opening disposed at the top of a first one of said plurality of side walls, said opening covered by a cap positionable in an opened and closed position; and an extendable straw, said straw having upper and lower portions, where said lower portion is disposed along said first side wall, parallel to both the edges of and the plane of said first sidewall, and wherein said upper portion is coupled with an inner side of said cap so that when said cap is in an opened position, said straw is available at said opening for use.

6. A cap assembly as set forth in claim 5, wherein said cap is a scored finger portion.

7. A cap assembly as set forth in claim 6, said straw further comprising pleats disposed between said upper portion of said straw located on said cap and said second lower portion disposed along said first side wall so that said straw can bend over a base of said scored finger portion.

8. A cap assembly as set forth in claim 6 wherein a top opening of said straw is disposed co-planar with a top side of said scored finger portion.

* * * * *